US006575815B1

(12) United States Patent
Schubert et al.

(10) Patent No.: US 6,575,815 B1
(45) Date of Patent: Jun. 10, 2003

(54) PROCESS FOR CALIBRATING THROTTLE BORES, IN PARTICULAR IN INJECTION VALVES FOR INTERNAL COMBUSTION ENGINES, AND DEVICE FOR EXECUTING THE PROCESS

(75) Inventors: Juergen Schubert, Bamberg (DE); Friedrich Weis, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/830,716

(22) PCT Filed: Aug. 18, 2000

(86) PCT No.: PCT/DE00/02822

§ 371 (c)(1),
(2), (4) Date: Sep. 5, 2001

(87) PCT Pub. No.: WO01/15859

PCT Pub. Date: Mar. 8, 2001

(30) Foreign Application Priority Data

Sep. 1, 1999 (DE) ..... 199 41 472

(51) Int. Cl.[7] ..... B24B 1/00

(52) U.S. Cl. ..... 451/38; 451/2; 451/5; 451/36; 451/60; 451/61; 451/76; 451/87

(58) Field of Search ..... 451/2, 5, 36, 38, 451/60, 61, 76, 87

(56) References Cited

U.S. PATENT DOCUMENTS 4,687,142 A * 8/1987 Sassao et al. ..... 239/533.3
5,054,247 A * 10/1991 Rhoades et al. ..... 451/36
6,306,011 B1 * 10/2001 Perry et al. ..... 451/38

* cited by examiner

*Primary Examiner*—Joseph J. Hail, III
*Assistant Examiner*—Shantese McDonald
(74) *Attorney, Agent, or Firm*—Ronald E. Greigg

(57) ABSTRACT

In a process and device for calibrating throttle bores, in particular in injection valves for internal combustion engines, by means of hydroerosive machining of the throttle bore with a suspension, the actual through flow is compared to a predetermined reference through flow. When the actual—and reference through flows coincide, the hydroerosive machining is brought to an end. On the outflow side of the throttle bore, a counterpressure is built up, which prevents the cavitation of the fluid.

10 Claims, 1 Drawing Sheet

PROCESS FOR CALIBRATING THROTTLE BORES, IN PARTICULAR IN INJECTION VALVES FOR INTERNAL COMBUSTION ENGINES, AND DEVICE FOR EXECUTING THE PROCESS

CROSS-REFERENCE TO RELATED APPLICATIONS

This application is a 35 USC 371 application of PCT/DE 00/02822 filed on Aug. 18, 2000.

BACKGROUND OF THE INVENTION

1. Field of the Invention

The invention relates to a process and to a device for executing the process for calibrating throttle bores, particularly throttle bores in injection valves for internal combustion engines.

2. Description of the Prior Art

It is known for throttle bores of the type in question to be hydroerosively machined by means of suspensions, e.g. comprised of a mineral oil of suitable viscosity containing abrasive grit, and in this connection, for the throttle bores to be calibrated to the through flow desired in the (subsequent) operation of the relevant work piece (so-called HE process). Since the machining pressure of the fluid at the outlet of the throttle bore decreases, cavitation occurs in the fluid, which leads to an undesirable dispersion of the cavitation-free through flow of the throttle bore.

SUMMARY OF THE INVENTION

The object of the invention is to improve the calibration of throttle bores so that a reduction of the dispersion of the cavitation-free through flow is produced.

According to the invention, the object is obtained with a process of the generic type described above and with a device for executing this process by producing a counterpressure at the outflow side of the throttle bore to thereby prevent cavitation of the fluid.

The invention permits a cavitation-free calibration of the throttle bore, since the counterpressure on the outflow side correspondingly reduces the pressure drop and as a result hinders the formation of gas bubbles in the machining fluid. Otherwise, the erosive abrasion machining of the throttle bore can take place in the usual way (e.g. in accordance with the HE process).

The process according to the invention consequently permits the dispersion of the cavitation-free through flow to be reduced from the previous ±3% to approx. ±0.6% in comparison to other pre-machining processes (e.g. drilling or erosion).

BRIEF DESCRIPTION OF THE DRAWINGS

The foregoing objects and advantages will become apparent from the detailed description contained below, taken with the drawings, in which.

DESCRIPTION OF THE PREFERRED EMBODIMENTS

Figure 1:
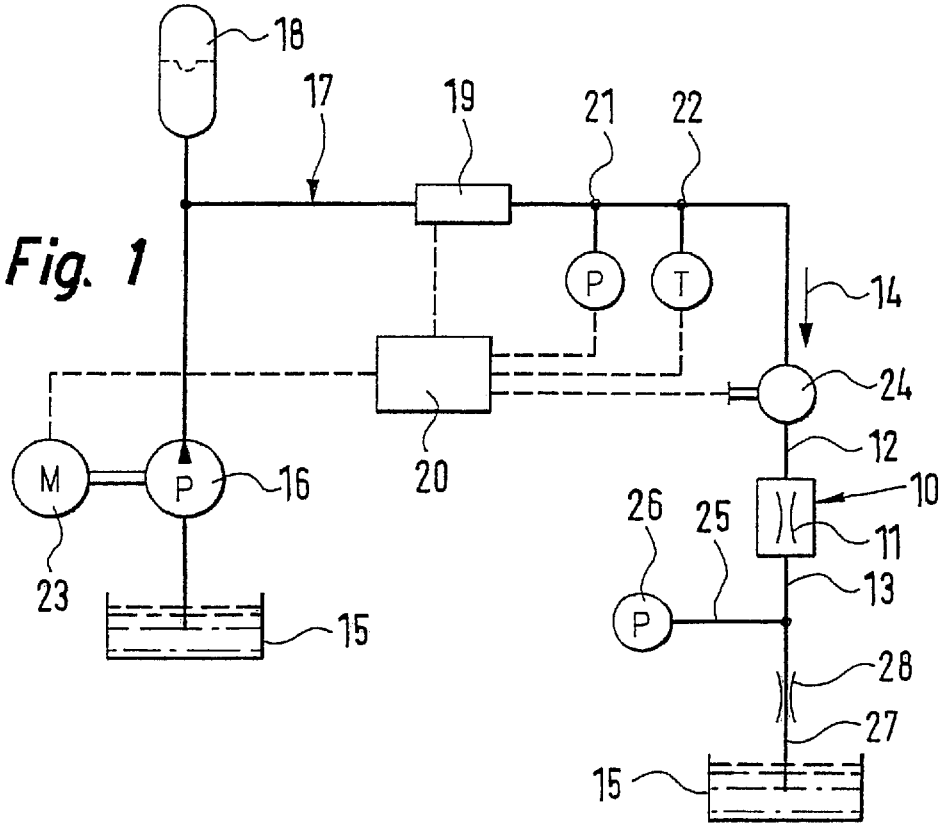
FIG. 1 is a schematic block circuit diagram of one embodiment of a device for executing the process according to the invention, with the through flow measurement system preceding the throttle bore to be calibrated.

Referring now to the drawings in detail, the reference numeral 10 indicates a work piece, e.g. a component from an injector of an injection system for internal combustion engines, with a throttle bore 11 to be calibrated by means of erosive machining with fluid. The inflow side of the work piece 10 and the throttle bore 11 is indicated by 12, the outflow side is indicated by 13, which permits the inference to be made that the fluid machining the throttle bore 11 flows in the direction of the arrow 14.

As shown in FIG. 1, the machining fluid, which is first contained in a tank 15 and is preferably comprised of a mineral oil with a viscosity of approximately 2 cSt and a temperature of approximately 40° C., is pumped into a line system 17 by a pump 16 and is brought to a suitable machining pressure (e.g. approximately 100 bar). A bubble- or membrane chamber 18 provides a compensation for possible delivery pressure fluctuations of the pump 16.

On its way to the work piece 10, the fluid flows through a through flow measurement system 19, which continuously supplies its measurement results to a computer 20. The pressure and temperature of the fluid, which are measured at 21 and 22, are likewise input to the computer 20. On the one hand, the computer controls the pump 16 by means of a pump drive motor 23 and on the other hand, it controls a shutoff valve 24. The respective actual through flow is thus measured in the through flow measurement system 19 and is continuously compared in the computer 20 to a predetermined reference through flow. When the through flow difference approaches zero, the shutoff valve 24 closes. This produces an exactly regulated through flow at the input of the throttle bore 11 (at 12).

On the outflow side 13 of the throttle bore 11, there is an orifice 28, which builds up a counterpressure. The counterpressure can be tested in a pressure sensor 26.

The counterpressure produced by the orifice 28 on the outflow side of the throttle bore 11 prevents cavitation from occurring in the fluid during the machining (calibration) of the throttle bore 11.

After flowing through the throttle bore 11 to be machined and the orifice 28, the fluid ends up in the collecting reservoir 15.

Figure 2:
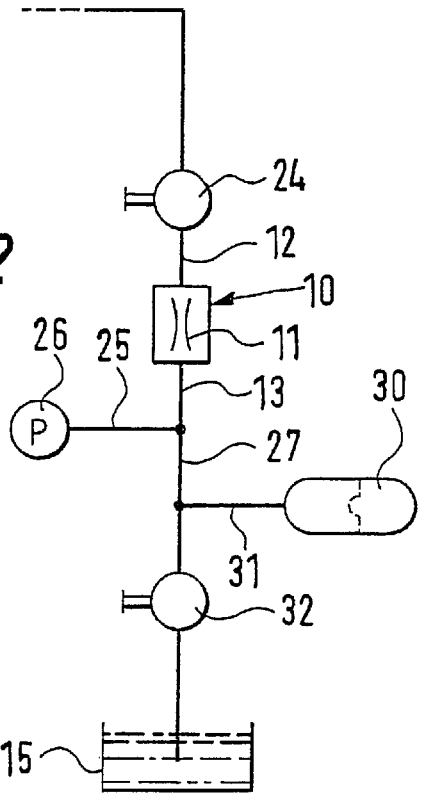
FIG. 2 is a schematic block circuit diagram of a modification of the device shown in FIG. 1.

The variant according to FIG. 2 differs from the embodiment according to FIG. 1 in that instead of the orifice 28 (FIG. 1), a bubble- or membrane chamber 30 is provided for producing a counterpressure. The bubble- or membrane chamber 30 is connected to the outflow line 27 by means of a branch line 31. After the bubble- or membrane chamber 30, a shutoff valve 32 is disposed in the outflow line 27.

During the abrasion process, the shutoff valve 32 is closed. After the end of the abrasion process, the quantity that has been fed through the throttle bore 11 of the work piece 10 during the abrasion process is drained off via the shutoff valve 32.

The foregoing relates to preferred exemplary embodiments of the invention, it being understood that other variants and embodiments thereof are possible within the spirit and scope of the invention, the latter being defined by the appended claims.

We claim:

1. In a process for calibrating a throttle bore by means of hydroerosive machining of the throttle bore with a fluid, the throttle bore having an inflow side (12) through which the fluid enters the throttle bore and an outflow side (13) through which the fluid exits the throttle bore, wherein actual through flow is compared to a predetermined reference through flow and when the actual and reference through flows coincide, the hydroerosive machining is brought to an end, the improvement wherein on the outflow side (13) of the throttle bore (11), a counterpressure is build up, which prevents cavitation of the fluid.

2. The process according to claim 1, wherein the counterpressure is 60 bar or approximately 60 bar.

3. The process according to claim 2, wherein viscosity and temperature of a machining fluid are selected so that they correspond to requirements of the calibrating process.

4. The process according to claim 1, wherein viscosity and temperature of a machining fluid are selected so that they correspond to requirements of the calibrating process.

5. The process according to claim 4, wherein the viscosity of the machining fluid is about 2.5 cSt and the temperature is about 40° C.

6. A device for calibrating a throttle bore by means of hydroerosive machining of the throttle bore with a fluid, the throttle bore having an inflow side (12) through which the fluid enters the throttle bore and an outflow side (13) through which the fluid exits the throttle bore, including a through flow measuring device on the inflow side (12) of the throttle bore (11) to be calibrated, the through flow measuring device, for the purposes of controlling through flow quantity, being connected to a computer (20), the improvement comprising a fluid outflow line (27) with an orifice (28) disposed in it, connected to the outflow side (13) of the throttle bore (11), said outflow line (27) and orifice (28) building a counterpressure which prevents cavitation of the fluid.

7. The device according to claim 6, wherein the orifice (28) is disposed in said outflow line (27) after a junction of a branch line (25), which leads to a pressure sensor (26).

8. The process according to claim 6, wherein viscosity of the machining fluid is about 2.5 cSt and temperature is about 40° C.

9. The device defined in claim 6, wherein said outflow line (27) and orifice (28) are dimensioned to produce a counterpressure of about 60 bar.

10. A device for calibrating a throttle bore by means of hydroerosive machining of the throttle bore with a fluid, the throttle bore having an inflow side (12) through which the fluid enters the throttle bore and an outflow side (13) through which the fluid exits the throttle bore, including a through flow measuring device on the inflow side (12) of the throttle bore (11) to be calibrated, the through flow measuring device, for the purposes of controlling through flow quantity, being connected to a computer (20), the improvement comprising a fluid outflow line (27) with a bubble- or membrane-chamber (30) connected therein is connected to the outflow side (13) of the throttle bore (11), said outflow line (27) and bubble- or membrane-chamber (30) building a counterpressure which is effective to prevent cavitation of the fluid.

* * * * *